US010786137B2

(12) United States Patent
Persson

(10) Patent No.: US 10,786,137 B2
(45) Date of Patent: Sep. 29, 2020

(54) DETERMINING WHETHER PROCESS WATER HAS BEEN ADDED TO A SUMP OF AN APPLIANCE FOR WASHING AND RINSING GOODS DURING INTERRUPTION OF APPLIANCE OPERATION

(71) Applicant: ELECTROLUX APPLIANCES AKTIEBOLAG, Stockholm (SE)

(72) Inventor: David Persson, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 338 days.

(21) Appl. No.: 15/772,221

(22) PCT Filed: Nov. 25, 2015

(86) PCT No.: PCT/EP2015/077675
§ 371 (c)(1),
(2) Date: Apr. 30, 2018

(87) PCT Pub. No.: WO2017/088917
PCT Pub. Date: Jun. 1, 2017

(65) Prior Publication Data
US 2018/0310798 A1 Nov. 1, 2018

(51) Int. Cl.
*A47L 15/02* (2006.01)
*A47L 15/42* (2006.01)
(Continued)

(52) U.S. Cl.
CPC ..... *A47L 15/4244* (2013.01); *A47L 15/0023* (2013.01); *A47L 15/0049* (2013.01);
(Continued)

(58) Field of Classification Search
None
See application file for complete search history.

(56) References Cited

U.S. PATENT DOCUMENTS 4,097,307 A 6/1978 Geiger
5,284,523 A 2/1994 Badami et al.
(Continued)

FOREIGN PATENT DOCUMENTS

CN 1 567 109 A 1/2005
CN 1 909 822 A 2/2007
(Continued)

OTHER PUBLICATIONS

Office Action for U.S. Appl. No. 16/071,273 dated Mar. 25, 2020.
(Continued)

*Primary Examiner* — Mikhail Kornakov
*Assistant Examiner* — Ryan L. Coleman
(74) *Attorney, Agent, or Firm* — Alston & Bird LLP

(57) ABSTRACT

Provided herein is a method performed by an appliance for washing and rinsing goods of detecting process water added to a sump of the appliance during interruption of operation of the appliance, upon recommence of appliance operation, and an appliance performing the method. The method may include detecting process water added to a sump of the appliance during interruption of operation of the appliance, upon recommence of appliance operation. The method may include increasing operating speed of a circulation pump of the appliance to a target speed, measuring an indication of circulation pump pressure or process water flow rate through the circulation pump, and determining that process water has been added to the sump of the appliance during the interruption in case the measured pressure or flow rate is maintained at a sufficient level after the speed of the circulation pump has reached the target speed.

14 Claims, 7 Drawing Sheets

(51) Int. Cl.
*A47L 15/00* (2006.01)
*F04D 15/00* (2006.01)
*F04D 15/02* (2006.01)

(52) U.S. Cl.
CPC ..... *A47L 15/4225* (2013.01); *A47L 2401/08* (2013.01); *A47L 2401/14* (2013.01); *A47L 2501/02* (2013.01); *F04D 15/0088* (2013.01); *F04D 15/0236* (2013.01)

(56) References Cited

U.S. PATENT DOCUMENTS

| | | | |
|---|---|---|---|
| 5,330,580 | A | 7/1994 | Whipple, III et al. |
| 6,655,922 | B1 | 12/2003 | Flek |
| 6,887,318 | B2 | 5/2005 | Bashark |
| 7,064,514 | B2 | 6/2006 | Iwaji et al. |
| 7,064,517 | B2 | 6/2006 | Kiuchi et al. |
| 7,241,347 | B2 | 7/2007 | Elick et al. |
| 7,776,159 | B2 | 8/2010 | Hooker et al. |
| 7,789,968 | B2 | 9/2010 | Elick et al. |
| 8,295,984 | B2 | 10/2012 | Heisele et al. |
| 8,439,052 | B2 | 5/2013 | Klein |
| 9,872,597 | B2 | 1/2018 | Pers et al. |
| 2001/0017145 | A1 | 8/2001 | Rosenbauer et al. |
| 2003/0034749 | A1 | 2/2003 | Zinke et al. |
| 2004/0099287 | A1 | 5/2004 | Shin |
| 2005/0005952 | A1 | 1/2005 | Bashark |
| 2006/0162438 | A1 | 7/2006 | Schofield et al. |
| 2006/0219262 | A1 | 10/2006 | Peterson et al. |
| 2006/0237048 | A1 | 10/2006 | Weaver et al. |
| 2007/0151579 | A1 | 7/2007 | Hooker et al. |
| 2007/0163626 | A1 | 7/2007 | Klein |
| 2007/0181156 | A1 | 8/2007 | Uz et al. |
| 2010/0275953 | A1 | 11/2010 | Orue Orue et al. |
| 2011/0038736 | A1 | 2/2011 | Hesterberg et al. |
| 2011/0048459 | A1 | 3/2011 | Hesterberg et al. |
| 2011/0126863 | A1 | 6/2011 | Kranzle et al. |
| 2011/0286859 | A1 | 11/2011 | Ortiz et al. |
| 2012/0000535 | A1 | 1/2012 | Poyner et al. |
| 2012/0006355 | A1 | 1/2012 | Heidel et al. |
| 2012/0048302 | A1 | 3/2012 | Didat |
| 2012/0048314 | A1 | 3/2012 | Vitan et al. |
| 2012/0060874 | A1 | 3/2012 | Gnadinger et al. |
| 2012/0266919 | A1 | 10/2012 | Kranzle et al. |
| 2013/0048025 | A1 | 2/2013 | Heidel et al. |
| 2014/0334945 | A1 | 11/2014 | Koehl |
| 2015/0305592 | A1 | 10/2015 | Pers et al. |
| 2016/0002942 | A1 | 1/2016 | Orlando |
| 2018/0283370 | A1 | 10/2018 | Slaby et al. |

FOREIGN PATENT DOCUMENTS

| | | | |
|---|---|---|---|
| DE | 197 50 266 | A1 | 5/1999 |
| DE | 10 2004 022 682 | B3 | 3/2006 |
| DE | 10 2007 041 313 | A1 | 3/2009 |
| DE | 10 2007 052 091 | A1 | 5/2009 |
| DE | 10 2008 020 475 | A1 | 11/2009 |
| DE | 10 2008 029 910 | A1 | 12/2009 |
| DE | 10 2011 000 287 | A1 | 7/2012 |
| DE | 10 2011 003 688 | A1 | 8/2012 |
| DE | 10 2014 105527 | B3 | 4/2015 |
| EP | 0326 893 | A2 | 8/1989 |
| EP | 1 112 016 | A1 | 7/2001 |
| EP | 1 284 540 | A2 | 2/2003 |
| EP | 1 574 161 | A1 | 9/2005 |
| EP | 1 737 332 | A1 | 1/2007 |
| EP | 2 213 217 | A1 | 8/2010 |
| EP | 2 248 935 | A1 | 11/2010 |
| EP | 2 407 078 | A2 | 1/2012 |
| EP | 2 609 845 | A1 | 7/2013 |
| EP | 2 672 875 | A1 | 12/2013 |
| JP | H 02 302239 | A | 12/1990 |
| JP | H 05 115414 | A | 5/1993 |
| JP | H0819506 | A | 1/1996 |
| JP | 2006 006 766 | A | 1/2006 |
| JP | 2011 143 130 | A | 7/2011 |
| KR | 10-2012-0022427 | A | 3/2012 |
| WO | WO 2005/070275 | A1 | 8/2005 |
| WO | WO 2005/089621 | A1 | 9/2005 |
| WO | WO 2006/116433 | A1 | 11/2006 |
| WO | WO 2008/125482 | A2 | 10/2008 |
| WO | WO 2009/027371 | A1 | 3/2009 |
| WO | WO 2009/068391 | A1 | 6/2009 |
| WO | WO 2009/156326 | A2 | 12/2009 |
| WO | WO 2012/107264 | A1 | 8/2012 |
| WO | WO 2012/146599 | A2 | 11/2012 |
| WO | WO 2014/005650 | A1 | 1/2014 |
| WO | WO 2014/071981 | A1 | 5/2014 |
| WO | WO 2014/106801 | A1 | 7/2014 |

OTHER PUBLICATIONS

International Search Report and Written Opinion for PCT/EP2012/072204 dated Sep. 6, 2013, 9 pages.
International Search Report and Written Opinion for International Application No. PCT/EP2012/072203, dated Sep. 6, 2013, 12 pages.
International Search Report and Written Opinion for Application No. PCT/EP2015/077675 dated Aug. 16, 2016, 9 pages.
International Search Report and Written Opinion for Application No. PCT/EP2015/076184 dated Feb. 8, 2016, 13 pages.
Office Action for Chinese Application No. 201280076924.9 dated Oct. 10, 2016, 12 pages.
Office Action from corresponding European Patent Application No. 12805601.7 dated Sep. 23, 2016, 4 pages.
Office Action from corresponding European Patent Application No. 12805600.9 dated Feb. 10, 2017, 4 pages.
EPO machine translation of WO2005070275 retrieved from https://worldwide.espacenet.com/publicationDetails/biblio?CC=WO&NR=2005070275A1&KC=A1&FT=D&ND=3&date=20050804&DB=&locale=en_EP on Nov. 28, 2016.
*Brushless DC electric motor*—Wikipedia, the free encyclopedia [online] [retrieved Nov. 19, 2013]. Retrieved from the Internet: <URL: http//en.wikipedia.org/Wiki/Brushless_DC_electric_motor>. 1 page.
Office Action from U.S. Appl. No. 14/439,351 dated Apr. 21, 2017.
Office Action for U.S. Appl. No. 14/439,351 dated Aug. 18, 2017.
Office Action for U.S. Appl. No. 14/439,346 dated Dec. 5, 2016.
Office Action for U.S. Appl. No. 14/439,346 dated Aug. 31, 2016.
Notice of Allowance for U.S. Appl. No. 14/439,346 dated Sep. 20, 2017.
Office Action for U.S. Appl. No. 14/439,351 dated May 16, 2018, 10 pages.
Notice of Allowance for U.S. Appl. No. 14/439,351 dated Nov. 15, 2018.
International Search Report and Written Opinion for International Application No. PCT/EP2016/053132 dated Nov. 9, 2016.
Notice of Allowance for U.S. Appl. No. 15/772,214 dated Nov. 19, 2019.

DETERMINING WHETHER PROCESS WATER HAS BEEN ADDED TO A SUMP OF AN APPLIANCE FOR WASHING AND RINSING GOODS DURING INTERRUPTION OF APPLIANCE OPERATION

CROSS-REFERENCE TO RELATED APPLICATIONS

This application is a national stage application filed under 35 U.S.C. § 371 of International Application No. PCT/EP2015/077675 filed Nov. 25, 2015, which application is hereby incorporated by reference in its entirety.

TECHNICAL FIELD

The invention relates to a method performed by an appliance for washing and rinsing goods of detecting process water added to a sump of the appliance during interruption of operation of the appliance, upon recommence of appliance operation, and an appliance performing the method.

BACKGROUND

In a washing appliance such as a dishwasher, it happens that operation of the dishwasher is unexpectedly interrupted. That is, the dishwasher is running a washing programme, when for instance a user opens a door to the compartment of the dishwasher, or a power failure occurs.

During such an interruption of normal operation of the dishwasher, water is sometimes added to a sump of the dishwasher. As an example, if the user opens the door to the compartment, he or she may discover that a bowl has been turned over in a rack of the dishwasher, whereupon the user turns the bowl over and thus adds a bowl full of water to the sump of the dishwasher, before closing the door and resuming the current washing programme.

This may affect performance of the dishwasher when the washing programme is resumed, or even result in an overflow situation. To this end, sensors are required for monitoring water levels in a compartment of the dishwasher, such as e.g. flow sensors, pressure sensors, pressure switches, float switches, etc. These sensors add to the complexity, and thus the cost, of the dishwasher.

SUMMARY

An object of the present invention is to solve, or at least mitigate, this problem in the art and to provide an improved method of detecting whether process water has been added to a sump of an appliance for washing and rinsing goods during interruption of operation of the appliance.

This is attained in a first aspect of the invention by a method performed by an appliance for washing and rinsing goods of detecting process water added to a sump of the appliance during interruption of operation of the appliance, upon recommence of appliance operation. The method comprises increasing operating speed of a circulation pump of the appliance to a target speed, measuring a parameter indicating circulation pump pressure or process water flow rate through the circulation pump, and determining that process water has been added to the sump of the appliance during the interruption in case the measured pressure or flow rate is maintained at a sufficient level after the speed of the circulation pump has reached the target speed.

This is attained in a second aspect of the invention by an appliance for washing and rinsing goods being configured to detect process water added to a sump of the appliance during interruption of operation of the appliance, upon recommence of appliance operation. The appliance comprises a circulation pump, a sensing arrangement arranged to measure a parameter indicating circulation pump pressure or process water flow rate through the circulation pump, a controller arranged to control operating speed of the circulation pump. The controller is further arranged to increase the operating speed of a circulation pump of the appliance to a target speed, and determine that process water has been added to the sump of the appliance during the interruption in case the measured pressure or flow rate is maintained at a sufficient level after the speed of the circulation pump has reached the target speed.

Advantageously, upon resuming a washing programme that was running before operation of the appliance, in the following being exemplified in the form of a dishwasher, was interrupted, the speed of the circulation pump is increased in to a predetermined target speed.

Typically, the target speed is a speed at which it is known that the circulation pump pressure or process water flow rate through the circulation pump would fall to an insufficient level, i.e. a level where the flow from the pump exceeds the flow to the pump and the pump thus draws air, if the amount of process water in the sump is at a desired level. It should be noted that this level typically will vary depending on the washing programme that the dishwasher is running, and on the type of dishwasher.

If during the increase of the circulation pump speed, it is measured that the circulation pump pressure or process water flow rate through the circulation pump remains at a sufficient level, i.e. a level where the flow from the pump does not exceed the flow to the pump, it can advantageously be concluded that process water has been added to the sump of the dishwasher during the interruption.

In contrast, in case the measured pressure or flow rate reaches an insufficient level, it is advantageously determined that no process water has been added to the sump of the dishwasher during the interruption.

In an embodiment, in case process water has been added during the interruption, the sump is drained on process water until the measured pressure or flow rate reaches an insufficient level, wherein the amount of process water advantageously has been restored at a desired level and the draining is stopped.

In a further embodiment, the drained process water is relocated to a storage tank of the dishwasher for subsequent reuse.

In yet an embodiment, insufficient circulation pump pressure or process water flow rate through the circulation pump is measured indirectly by measuring operating current of a motor driving the circulation pump. This may be measured by measuring the voltage of a known shunt resistor in the motor and calculating the current by using Ohm's law. Measured current can be directly translated into circulation pump torque; the higher the torque, the higher the operating current of the motor driving the pump, and a higher pump torque implies a greater flow of process water through the circulation pump. Measuring operating current of the circulation pump motor is in itself advantageous as compared to using a relatively expensive pressure or flow rate sensor to measure the pump pressure or flow of process water through the pump. With the measured operating current, it can be determined whether the pressure or flow is insufficient, or whether it has been restored to a sufficient level.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description. The washing appliance of the invention will subsequently be exemplified by a dishwasher.

Figure 1:
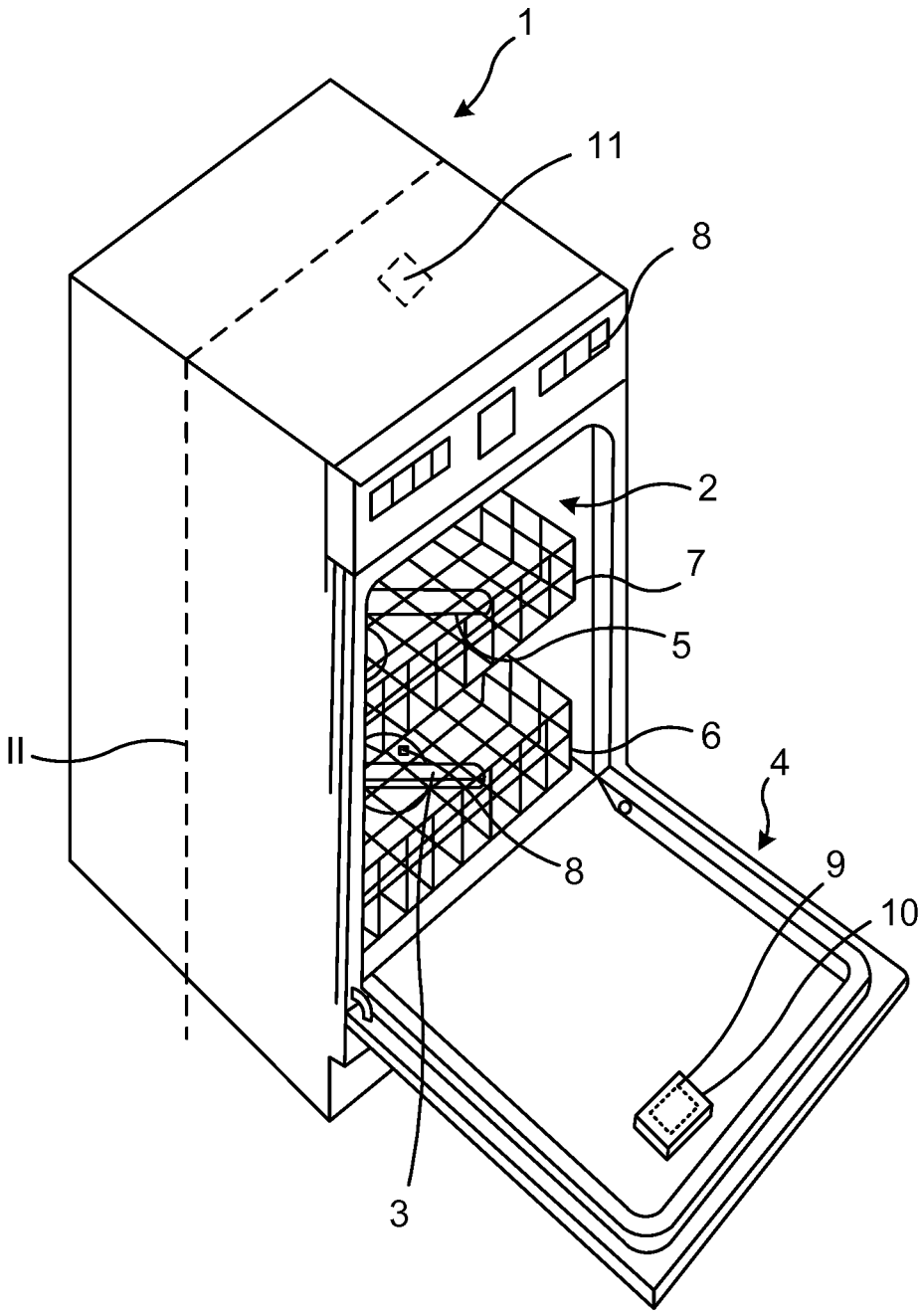
FIG. 1 shows a prior art dishwasher in which the present invention can be implemented.

FIG. 1 shows a prior art dishwasher 1 in which the present invention can be implemented. It should be noted that dishwashers can take on many forms and include many different functionalities. The dishwasher 1 illustrated in FIG. 1 is thus used to explain different embodiments of the present invention and should only be seen as an example of a dishwasher in which the present application can be applied.

The exemplifying dishwasher 1 comprises a washing compartment or tub 2, a door 4 configured to close and seal the washing compartment 2, a spraying system having a lower spray arm 3 and an upper spray arm 5, a lower rack 6 and an upper rack 7. Additionally, it may comprise a specific top rack for cutlery (not shown). A controller 11 such as a microprocessor is arranged in the interior of the dishwasher for controlling washing programmes and is communicatively connected to an interface 8 via which a user can select washing programmes.

The door 4 of the prior art dishwasher 1 illustrated in FIG. 1 is further on its inside arranged with a small detergent dispenser 9 having a lid 10 being controllably opened and closed by the controller 11 for dispensing detergent from the dispenser 9 into the tub 2.

Figure 2:
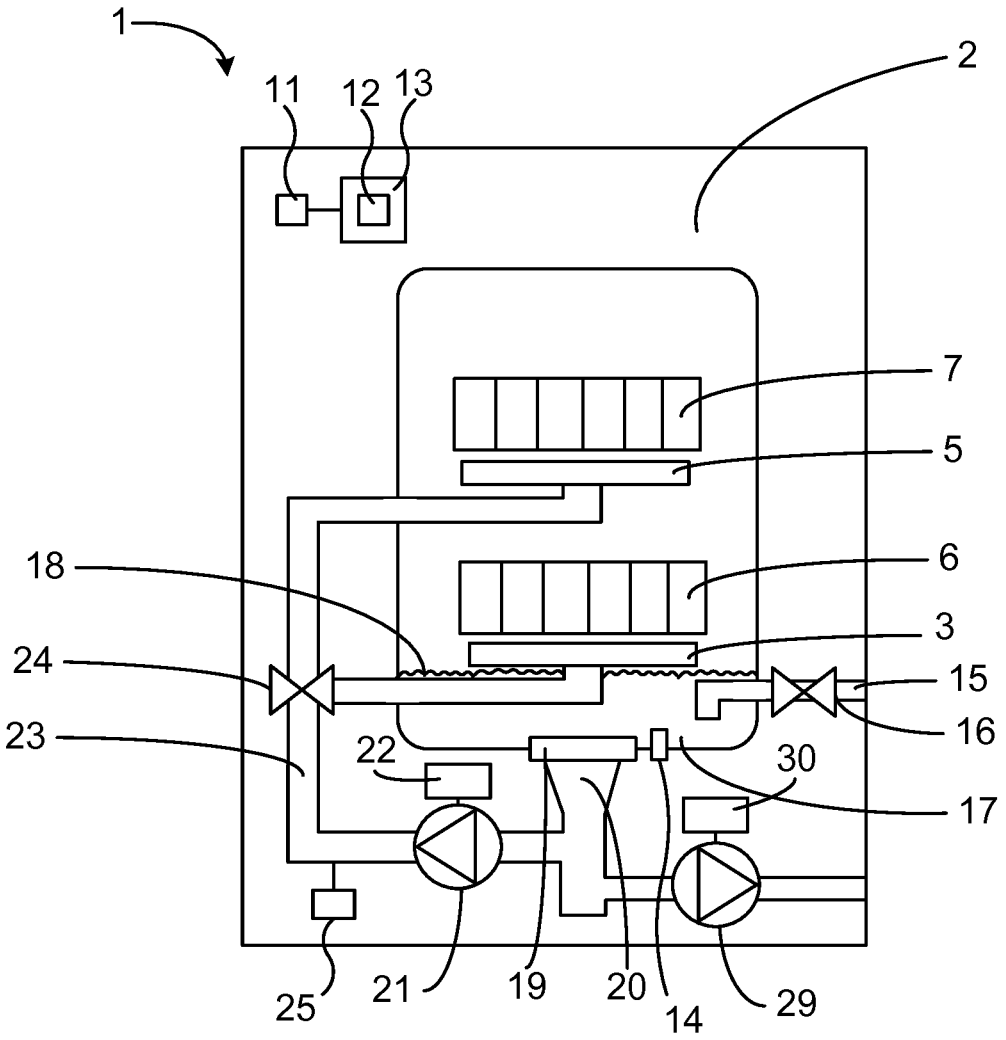
FIG. 2 schematically illustrates a cross-sectional view of the dishwasher of FIG. 1 taken along section II.

FIG. 2 schematically illustrates a cross-sectional view of the dishwasher 1 of FIG. 1 taken along section II, to further illustrate components included in a dishwasher 1. Hence, as previously mentioned, the dishwasher 1 comprises a washing compartment or tub 2 housing an upper basket 7 and a lower basket 6 for accommodating goods to be washed such as cutlery, plates, drinking-glasses, trays, etc.

Detergent in the form of liquid, powder or tablets is dosed in a detergent compartment located on the inside of a door (not shown in FIG. 2) of the dishwasher 1 by a user, which detergent is controllably discharged into the washing compartment 2 in accordance with a selected washing programme. As previously mentioned, the operation of the dishwasher 1 is typically controlled by the controller 11 executing appropriate software 12 stored in a memory 13.

Fresh water is supplied to the washing compartment 2 via water inlet 15 and water supply valve 16. This fresh water is eventually collected in a so called sump 17, where the fresh water is mixed with the discharged detergent resulting in process water 18. The opening and closing of the water supply vale 16 is typically controlled by the controller 11.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle. The pressurized fluid supplied to the detergent dispensing device according to embodiments of the invention thus at least partly contains process water.

At the bottom of the washing compartment is a filter 19 for filtering soil from the process water before the process water leaves the compartment via process water outlet 20 for subsequent re-entry into the washing compartment 2 through circulation pump 21. Thus, the process water 18 passes the filter 19 and is pumped through the circulation pump 21, which typically is driven by a brushless direct current (BLDC) motor 22, via a duct 23 and process water valve 24 and sprayed into the washing compartment 2 via nozzles (not shown) of a respective wash arm 3, 5 associated with each basket 6, 7. Thus, the process water 18 exits the washing compartment 2 via the filter 19 and is recirculated via the circulation pump 21 and sprayed onto the goods to be washed accommodated in the respective basket via nozzles of the wash arms 3, 5. Further, a controllable heater 14 is typically arranged in the sump 17 for heating the process water 18.

The washing compartment 2 of the dishwasher 1 is drained on process water 18 with a drain pump 29 driven by a BLDC motor 30. It should be noted that it can be envisaged that the drain pump 29 and the circulation pump 21 may be driven by one and the same motor.

A sensing arrangement 25 may be arranged at the circulation pump 21 for measuring flow rate of the process water 18 passing through the circulation pump 21, or the pressure of the circulation pump 21. The sensing arrangement may be embodied in the form of a pressure or flow rate transducer. Alternatively, the sensing arrangement 25 may be implemented in the form of a resistor arranged at the circulation pump motor 22 for measuring operation current of the motor. Practically, this is undertaken by measuring the operating voltage of a known shunt resistor in the motor 22 of the circulation pump 21 and calculating the operating current. From the measured current, it is determined whether the pressure/flow rate is sufficient or not. The current is thus a parameter indicating pressure of flow rate.

Figure 3A:
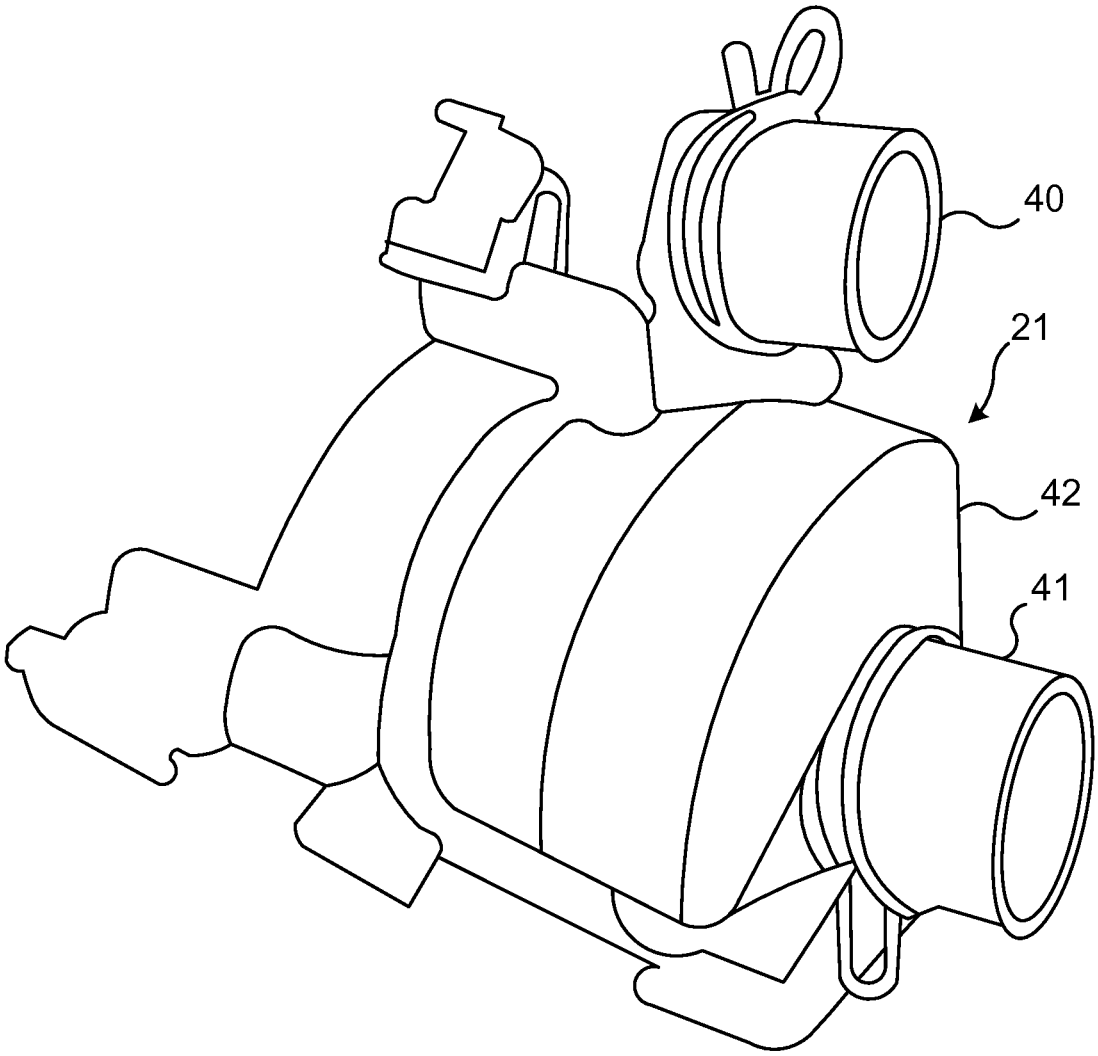
FIGS. 3*a* and *b* illustrate two different views of a circulation pump which can be controlled according to embodiments of the present invention.

FIG. 3*a* shows a view of an exemplifying circulation pump 21. The speed of the circulation pump 21 is typically controlled by the controller 11. FIG. 3*a* shows an outlet 40 (referred to as a discharge port) of the circulation pump 21 and an inlet 41. The casing 42 of the circulation pump 21 is referred to as the volute and can be removed from a main body 43 of the circulation pump 21.

Figure 3B:
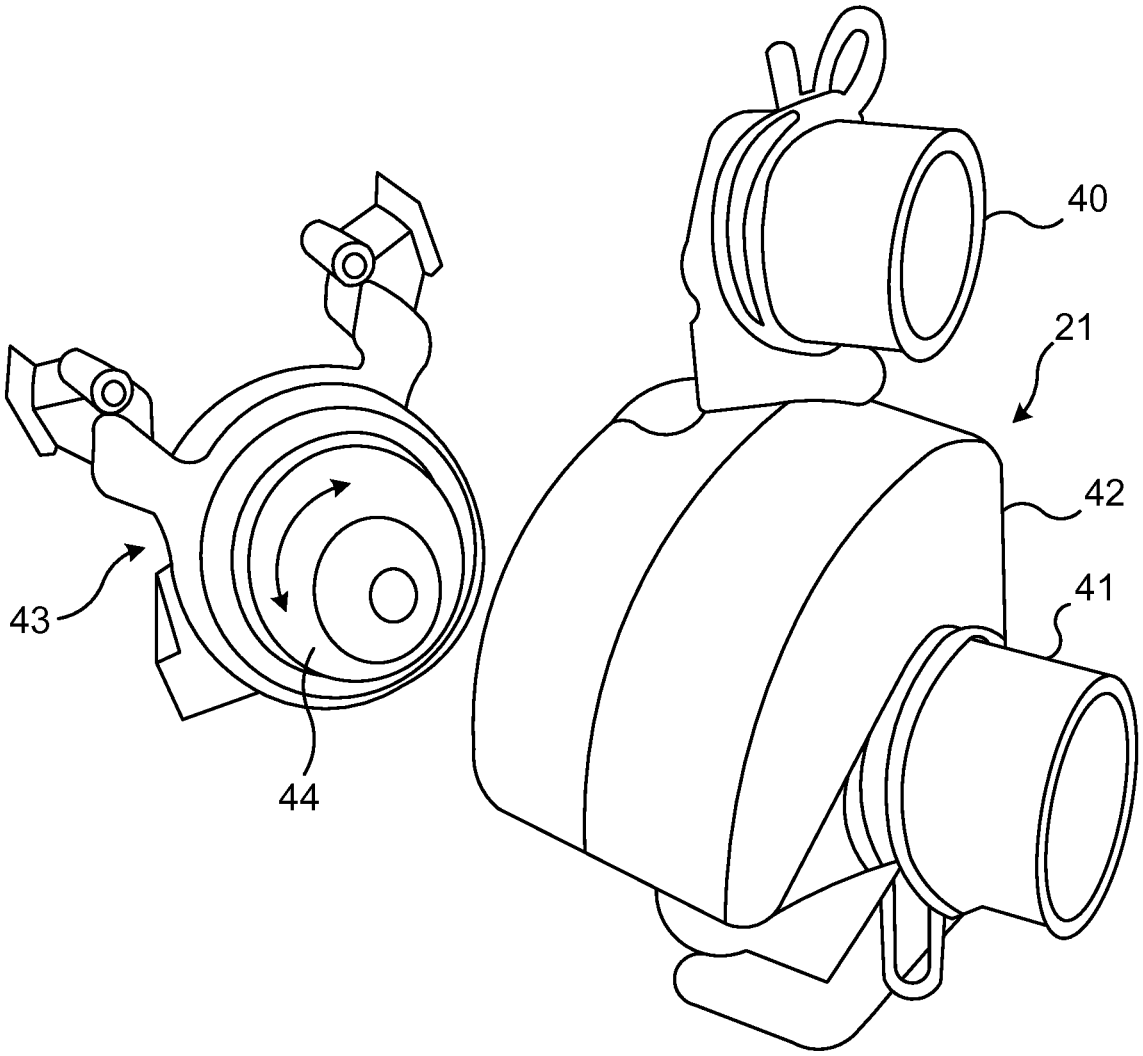

FIG. 3*b* shows a further view of the circulation pump 21 of FIG. 3*a*, where the volute 42 has been removed from the main body 43 of the circulation pump, thereby revealing the impeller 44 of the circulation pump which under operation pumps the process water that is entering the circulation pump 21 via the inlet 41. The process water that is pumped by the impeller 44 is subsequently received by the volute 42, which slows down the flow rate of the process water, and exits the circulation pump 21 via the outlet 40.

Now, where the process water 18 flowing to the circulation pump 21 is in contact with vacuum or any gas, for instance via an evaporator, a lower flow of process water to the pump 21 than from the pump will eventually cause a pressure loss due to vacuum or gas inside the pump 21.

Figure 4A:
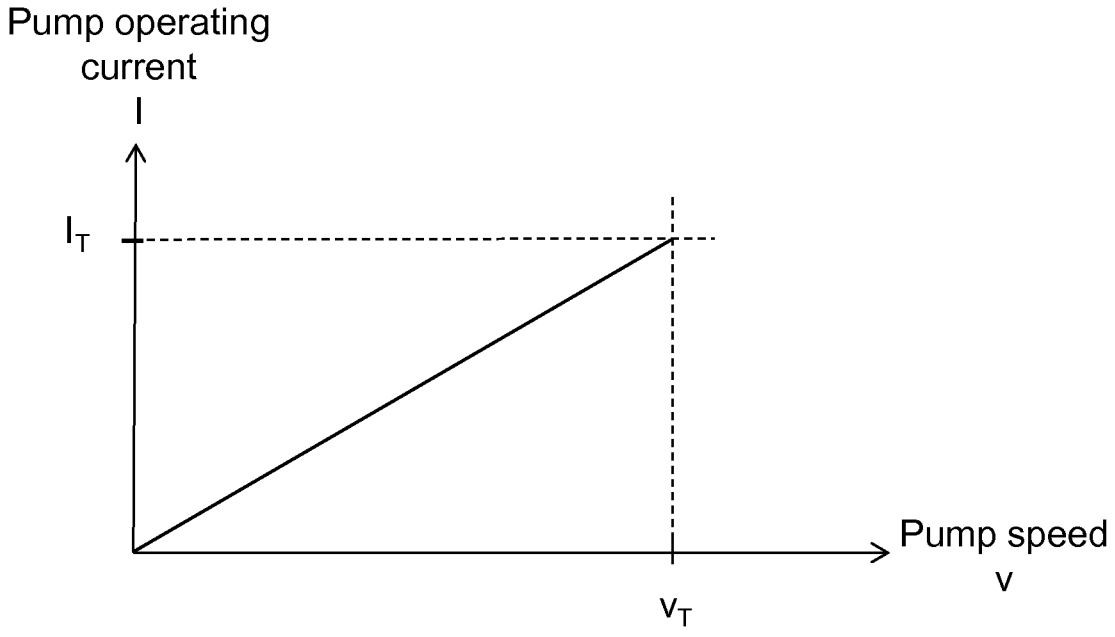
FIG. 4*a* illustrates operating current of the circulation pump as a function of increased pump speed when a washing programme resumes after having been interrupted, but where process water has been added to the sump according to an embodiment of the invention.

FIGS. 4*a* and *b* illustrate an embodiment of the invention where operation of the dishwasher is unexpectedly interrupted. That, is, the dishwasher 1 is running a washing programme, when for instance a user opens the door 4 to the compartment 2 of the dishwasher 1 or e.g. a power failure occurs.

FIG. 4*a* illustrates operating current of the circulation pump 21 as a function of increased pump speed when the washing programme resumes after having been interrupted, but where process water has been added to the sump according to an embodiment of the invention.

Figure 4B:
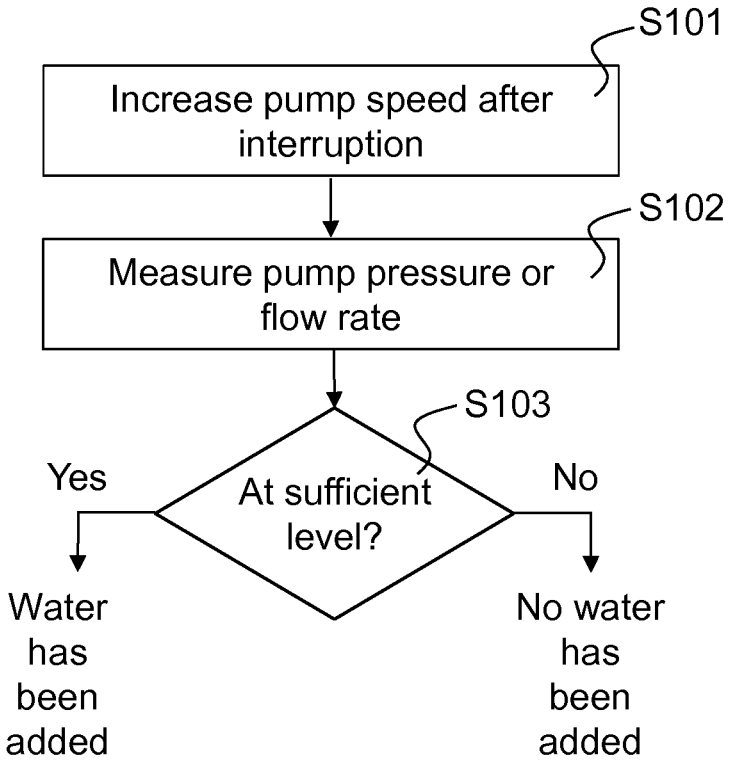
FIG. 4*b* shows a flowchart illustrating an embodiment of a method according to the invention of determining whether process water has been added to a sump of the dishwasher during the interruption of the washing programme.

FIG. 4*b* shows a flowchart illustrating an embodiment of a method according to the invention of determining whether process water has been added to the sump 17 of the dishwasher 1 during the interruption of the washing programme.

If the user opens the door 4 to the compartment 2, he or she may discover that a bowl has been turned over in the upper rack 7 of the dishwasher 1, whereupon the user turns the bowl over and thus adds a bowl full of water to the sump 17 of the dishwasher 1, before closing the door 4 and resuming the current washing programme.

In order to appropriately run the various washing programmes in a dishwasher, it is generally desirable that the amount of process water in the compartment 2 is known in order for the controller 1 to determine whether additional fresh water should be added via water inlet 15 and water supply valve 16, or if the dishwasher 1 should be drained on process water 18 to comply with requirements of the currently selected washing programme, or whether any adjustment should be made to the washing programme.

It should be noted that while the process water 18 may be drained via the process water outlet 20 and the drain pump 29 to leave the compartment 2 for further transport to a sewer system, it is also envisaged in an embodiment of the invention that the drained process water 18 advantageously is relocated to a storage tank (not shown) of the dishwasher 1, either inside or outside the compartment 2 for subsequent reuse.

Upon resuming the washing programme that currently was running before the user opened the door 4, the speed of the circulation pump is increased in step S101 to a predetermined target speed, at which speed it is known that the circulation pump pressure or process water flow rate through the circulation pump 21 would fall to an insufficient level if the amount of process water 18 in the sump 17 is at a desired level. It should be noted that this level typically will vary depending on the washing programme that the dishwasher is running, and on the type of dishwasher.

If during the increase of the circulation pump speed the circulation pump pressure or process water flow rate through the circulation pump 21 remains at a sufficient level as measured in step S102, it can be concluded in step S103 that process water 18 has been added to the sump 17 of the dishwasher 1 during the interruption.

Hence, the controller 11 increases the speed of the circulation pump 21 in step S101 and measures in step S102, via the sensing arrangement 25, the circulation pump pressure or process water flow rate through the circulation pump 21. The controller 11 thereafter determines in step S103, whether the measured circulation pump pressure or process water flow rate through the circulation pump 21 is at a sufficient level. If so, process water 18 is considered to have been added to the sump 17 during the interruption. If not, the controller 11 concludes that no process water 18 has been added to the sump 17 during the interruption.

The pressure/flow rate may be measured by reading a pressure or flow rate transducer, or as is performed in an embodiment of the invention, by measuring the operating voltage of a known shunt resistor in the motor 22 of the circulation pump 21 and calculating the operating current. From the measured current, it is determined whether the pressure/flow rate is sufficient or not.

Measured current can be directly translated into circulation pump torque; the higher the torque, the higher the operating current of the motor 22 driving the pump 21, and a higher pump torque implies a greater flow of process water through the circulation pump. When the operating current decreases to a particular level, it can thus be deducted that the process water flow from the pump exceeds the flow of process water to the pump, thereby indicating an insufficient pressure or flow rate. Hence, it is possible to determine pressure or flow rate by determining a difference in measured current, such as a difference, or change, from a nominal measured current value.

As is illustrated in FIG. 4*a*, the operating current will increase linearly with the increasing pump speed to the target speed $v_T$ (and a corresponding current $I_T$) since a steady flow of process water passes through the circulation pump 21 in an example where process water 18 indeed has been added to the sump 17 by the user during the interruption of the washing programme.

Figure 5:
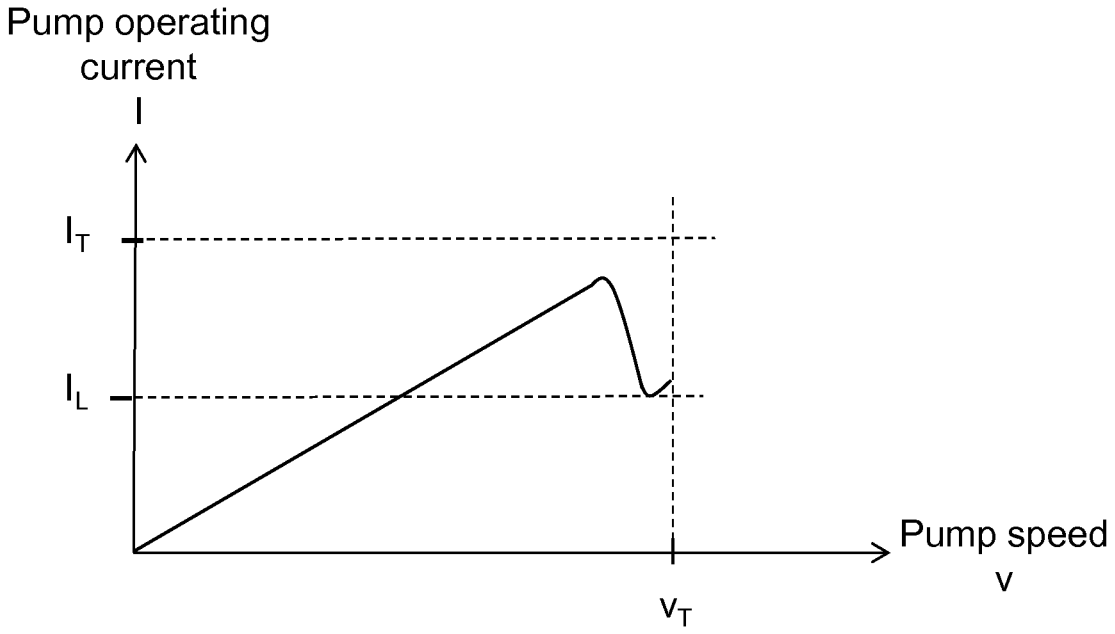
FIG. 5 illustrates operating current of the circulation pump as a function of increased pump speed when a washing programme resumes after having been interrupted, but where no process water has been added to the sump according to an embodiment of the invention.

FIG. 5 illustrates operating current of the circulation pump 21 as a function of increased pump speed when the washing programme resumes after having been unexpectedly interrupted, but where no process water has been added to the sump according to an embodiment of the invention.

With further reference to the flowchart of FIG. 4*a*, upon the controller 11 resuming the washing programme that currently was running before the user opened the door 4, the speed of the circulation pump is increased in step S101.

If during the increase of the circulation pump speed the circulation pump pressure or process water flow rate, indirectly measured by measuring the operating current of the circulation pump 21 in step S102, falls to an insufficient level (represented by current IL) where the flow from the pump exceeds the flow to the pump, it can be concluded in step S103 that no process water 18 has been added to the sump 17 of the appliance 1 during the interruption. Hence, the circulation pump 21 will start to draw air, and the torque—and corresponding pump operating current—will consequently decrease.

Figure 6:
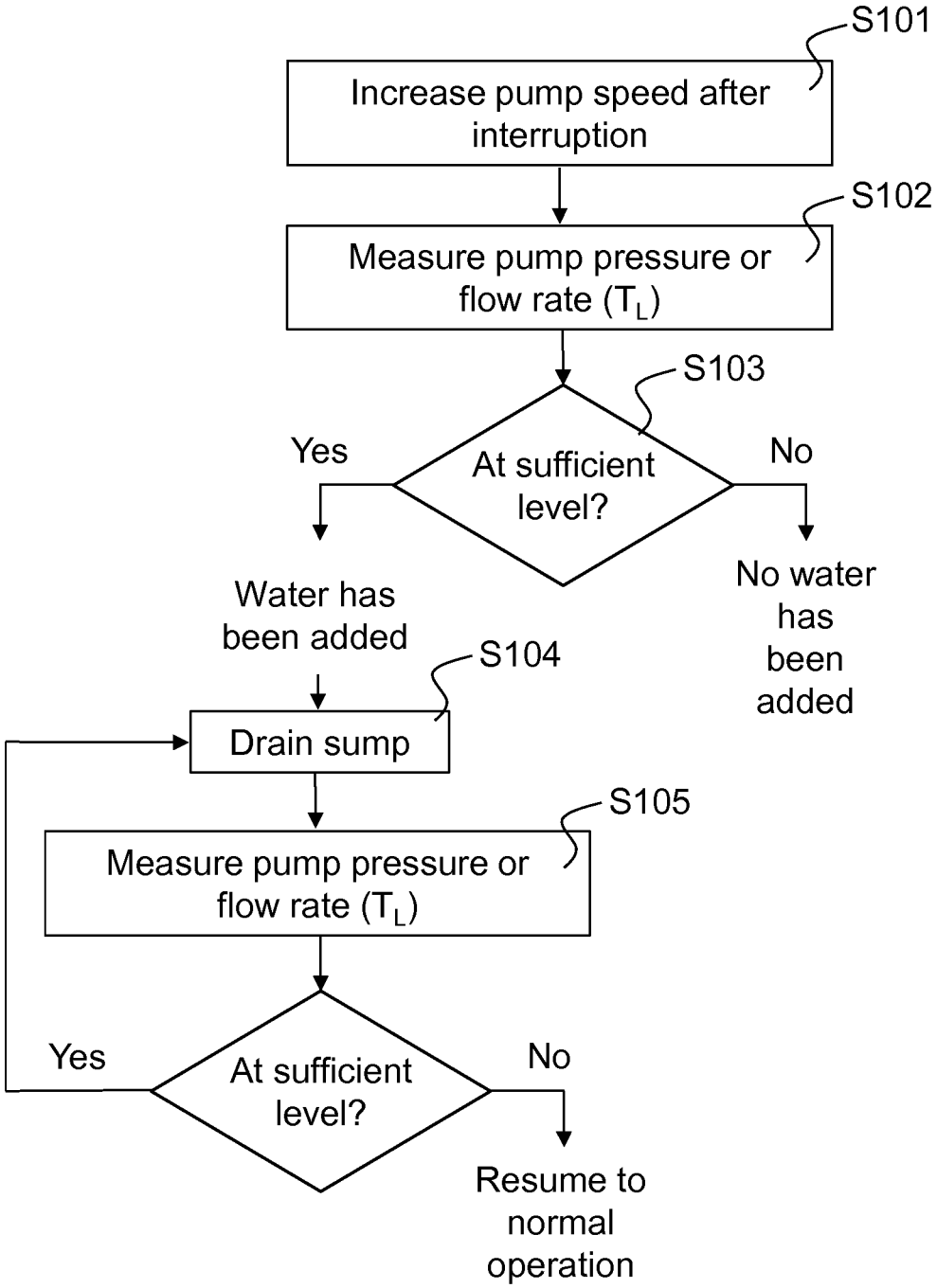
FIG. 6 illustrates a flowchart of a further embodiment of the method according to the invention.

FIG. 6 illustrates a flowchart of a further embodiment of the method according to the invention.

If in step S103, the controller 11 concludes that process water 18 has been added to the sump 17 of the dishwasher 1, it drains the sump 17 on process water 18 until a desired amount of water is contained in the sump 17. As previously discussed, the process water may be drained to a sewer system or to a storage tank for subsequent reuse.

While draining the sump 17, the controller again measures in step S105 circulation pump pressure or process water flow rate through the circulation pump 21, wherein in case the measured pressure or flow rate reaches an insufficient level, the circulation pump 21 again draws air, and the amount of process water has been restored at a desired level. The draining is thus stopped, and normal dishwasher operation may advantageously be resumed.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method performed by an appliance for washing and rinsing goods, wherein the appliance comprises a controller for controlling one or more operations of the appliance and the method is a method of detecting process water added to a sump of the appliance during interruption of operation of the appliance, upon recommence of appliance operation, the method comprising:

increasing operation speed of a circulation pump of the appliance to a target speed;

measuring a parameter indicating circulation pump pressure or process water flow rate through the circulation pump;

determining, via the controller, that process water has been added to the sump of the appliance during the interruption when the measured parameter indicates that the circulation pump pressure or process water flow rate is maintained at a sufficient level after the speed of the circulation pump has reached the target speed, wherein the sufficient level is a level at which a flow to the circulation pump is greater than or equal to a flow from the circulation pump.

2. The method of claim 1, further comprising:

draining process water from the sump; and wherein when the measured parameter indicates that the circulation pump pressure or process water flow rate reaches an insufficient level, the process water is determined to have been restored to a particular level and the draining is stopped, wherein the insufficient level is a level at which the flow to the circulation pump is less than the flow from the circulation pump.

3. The method of claim 2, wherein appliance operation is resumed once the process water is determined to have been restored to the particular level.

4. The method of claim 2, wherein the draining of the sump comprises:

relocating the drained process water to a storage tank of the appliance for subsequent reuse.

5. The method of claim 1, wherein when the measured parameter indicates that the circulation pump pressure or process water flow rate reaches an insufficient level, it is determined that no process water has been added to the sump of the appliance during the interruption, wherein the insufficient level is a level at which the flow to the circulation pump is less than the flow from the circulation pump.

6. The method of claim 1, the target speed being a predetermined circulation pump speed wherein the circulation pump pressure or process water flow rate through the circulation pump will reach an insufficient level if the amount of process water in the sump is at a particular level, wherein the insufficient level is a level at which the flow to the circulation pump is less than the flow from the circulation pump.

7. The method of claim 1, the measuring the parameter indicating circulation pump pressure or process water flow rate through the circulation pump of the appliance comprising:

measuring operating current of a motor driving the circulation pump.

8. An appliance for washing and rinsing goods, wherein the appliance is configured to detect process water added to a sump of the appliance during interruption of operation of the appliance, upon recommence of appliance operation, comprising:

a circulation pump;

a sensing arrangement;

a controller configured to control operating speed of the circulation pump, wherein the controller further is configured to:

increase the operating speed of a circulation pump of the appliance to a target speed;

measure, via the sensing arrangement, a parameter indicating circulation pump pressure or process water flow rate through the circulation pump;

determine that process water has been added to the sump of the appliance during the interruption when the measured parameter indicates that the circulation pump pressure or process water flow rate is maintained at a sufficient level after the speed of the circulation pump has reached the target speed, wherein the sufficient level is a level at which a flow to the circulation pump is greater than or equal to a flow from the circulation pump.

9. The appliance of claim 8, further comprising:

a drain pump; and the controller further being configured to control the drain pump to drain process water from the sump, and to determine whether the measured parameter indicates that thecirculation pump pressure or process water flow rate through the circulation pump reaches an insufficient level, in which case the amount of process water is determined to have been restored to a particular level and the draining is stopped, wherein the insufficient level is a level at which the flow to the circulation pump is less than the flow from the circulation pump.

10. The appliance of claim 9, the controller further being configured to resume appliance operation once the process water is determined to have been restored to the particular level.

11. The appliance of claim 9, the drain pump being arranged to relocate the process water drained from the sump to a storage tank of the appliance for subsequent reuse.

12. The appliance of claim 8, the sensing arrangement being arranged to measure operating current of a motor driving the circulation pump in order to measure the parameter indicating circulation pump pressure or process water flow rate through the circulation pump.

13. The appliance of claim 12, wherein the sensing arrangement comprises:

a resistor arranged at the motor driving the circulation pump, through which resistor operating current of the motor is measured, in order to attain the parameter indicating circulation pump pressure or process water flow rate through the circulation pump.

14. A non-transitory computer readable medium storing a program that, when executed by at least one processor, causes the method of claim 1 to be performed by an appliance for washing and rinsing goods.

* * * * *